United States Patent [19]

Pemrick

[11] 4,214,877

[45] Jul. 29, 1980

[54] FINE GRIT ABRASIVE

[75] Inventor: Raymond E. Pemrick, Schenectady, N.Y.

[73] Assignee: Norton Company, Worcester, Mass.

[21] Appl. No.: 971,839

[22] Filed: Dec. 19, 1978

Related U.S. Application Data

[63] Continuation-in-part of Ser. No. 785,899, Apr. 8, 1977, abandoned.

[51] Int. Cl.[2] ..... B24D 11/02

[52] U.S. Cl. ..... 51/295; 51/298

[58] Field of Search ..... 51/298, 295

[56] References Cited

U.S. PATENT DOCUMENTS

| | | | |
|---|---|---|---|
| 3,044,891 | 7/1962 | Lauchenauer | 51/298 |
| 3,787,273 | 1/1974 | Okrepkie | 51/297 |
| 3,861,892 | 1/1975 | Wisdom et al. | 51/294 |
| 4,035,961 | 7/1977 | Pemrick et al. | 51/295 |
| 4,111,667 | 9/1978 | Adams | 51/298 |

*Primary Examiner*—Donald J. Arnold

*Attorney, Agent, or Firm*—Rufus M. Franklin

[57] ABSTRACT

Calendaring of woven polyester fabric at 20 to 60 tons pressure and 200° to 380° F., provides a smooth surface, upon which fine grit abrasive may be applied, to produce flexible coated abrasive articles for polishing applications.

2 Claims, No Drawings

FINE GRIT ABRASIVE

RELATION TO OTHER APPLICATIONS

This application is a continuation-in-part of application Ser. No. 785,899, filed Apr. 8, 1977 now abandoned.

FIELD OF THE INVENTION

The invention relates to fine grit coated abrasive products on woven polyester fabric backings.

BACKGROUND OF THE INVENTION

Recently, dimensionally stable woven-polyester backings have been commercially employed as backings for coarse grit (coarser than 100 grit) flexible coated abrasive products. Because of the inherent roughness of the surface of woven fabric relative to the dimensions of very fine grit, some difficulty has been experienced in employing standard types of such backings for fine grit (100 or 120 to 600 grit), because conventional calendaring (as used for cotton), or the use of fill coatings, to smooth the surface to which the abrasive is applied, have not been satisfactory.

SUMMARY OF THE INVENTION

The present invention resides in the discovery that the use of very high calendaring pressure together with the use of a limited range of elevated temperature, enables the production of a smooth surface on commercially available polyester woven cloth, for coated abrasive use, suitable for the production of fine grit (100 to 600 grit size) products.

Specifically, the use of from 600 to 2000 pounds per lineal inch of cloth, and a temperature of 210° to 380° F., have been found satisfactory, when the web is passed between a set of conventional calendar rolls at a speed of from 20 to 75 feet per minute. More preferable the pressure is from 800 to 1600 pounds per lineal inch, and the temperature from 230° to 300° F.

After calendaring the cloth is finished in a conventional manner, by application of adhesive and abrasive grain on one side, to produce a coated abrasive product.

Suitable cloth for this application is a dimensionally stable polyester woven fabric having a weight of up to 9.5 ounces per square yard (most cloth lighter than 3.5 ounces per square yard can be manufactured smooth enough). The weave can be square, twill, or sateen weave, but square weave is preferred. The yarn weight can vary from yarn numbers of 6 to 30 for staple yarns (cotton count), to 100 to 1100 denier, for continuous multifilament yarns.

Conventional manufacturing methods are used to produce a finished coated abrasive product from the backing. The cloth, as calendered according to this invention will show a flattening of the fill yarns of the cloth, but will show no indication of any fusion to the yarns. Excessive heat or heat and pressure will destroy the desired dimensional stability of the cloth, significantly reduce the adhesion of the maker coat to the backing, and will weaken it in tensile and tear strength. Calendaring within the limits of pressure and temperature of this invention, will produce a smooth surface, dimensional stability within the required limits, proper adhesion, and, surprisingly, no decrease in tear strength.

The elongation profile in the warp direction of the cloth, after calendering should have the following character:

| Elongation | | Load-Pounds Per Inch of Width |
|---|---|---|
| Not greater than | 6% | 50 |
| | 9% | 100 |
| | 17% | 200 |

Since the calendering does not improve the stability of the cloth, the fabric, prior to calendering must also have equivalent dimensional stability. Such material is disclosed in U.S. Ser. No. 590,989, filed June 27, 1975.

Since the calendering also degrades the adhesion of coatings to the fabric, the calendering must be controlled so that the peel strength adhesion, as defined below is, reduced by not more than 40%, and preferably by not more than 20%. The following is the method used for determining peel adhesion of greige or finished cloth samples.

Cloth samples 5 in. wide by 12 in. long are coated on one side with a frontsize formulation containing 1 part phenolic resin (V-1237A-Bendix Corp), 0.11 part phenolic resin BM-42 (Bendix Corp), and 1.1 part calcium carbonate (avg. particle size, 13.7$\mu$). This adhesive formulation is applied with a hand roller with light pressure so that a continuous adhesive film completely covers the square side of the fabric. The coated fabric is then folded in half, adhesive to adhesive, the two top surfaces are separated with a paper towel approximately 1 inch. The bottom of the folded sample is trimmed to remove the fold line. The folded sample is then again rolled with the hand roller using light pressure to remove any air bubbles in the adhesive sandwich. It will be observed that some of the adhesive will overflow from the two sides and the bottom of the fabric sandwich. The "sandwich" layers are stapled on three sides with industrial staples. The sample is then placed in a forced air oven and dried by the following cure cycle, 20 min. at 125° F. 20 min. at 150° F. 20 min. at 175° F. 20 min. at 200° F., followed by 6 hrs. at 235° F.

After the cure cycle, the samples are conditioned for 24 hrs. at 50% R.H. and 70° F. 1 inch wide samples are cut from the cured fabric sandwich and tested for peel adhesion on the Instron Tensile Tester using the following conditions—2½ in. gauge opening, chart speed—5 inch/min. jaw speed—5 in./min. Range: 50 lbs. The peel is measured at 180° with one end of the sample in the top jaw and the other end in the bottom jaw.

By fine grit, is meant abrasive grains (e.g. silicon carbide, aluminum oxide, co-fused alumina zirconia, garnet, and flint), having a grit size of from 100 to 600 grit (approximately 170 microns or 6700 microinches to 8 microns or 315 microinches). Suitable cloth for this application should thus have a roughness in terms of valleys and peaks in its surface no greater than about 2500 microinches, for the course grits, and 200 microinches for the finest grits.

In particular, the surface roughness reduction from the uncalendered cloth should be from 55 to 85%, and the thickness reduction should be from 20 to 35%, preferably 20 to 30%. Within these limits it has been found that suitable fine grit backings can be produced by calendering between the specified invention limits of 600 to 2000 pounds per lineal inch of cloth, at speeds from 20 to 70 feet per minute and at a temperature range of 230° to 300° F.

EXAMPLE OF SPECIFIC EMBODIMENT OF THE INVENTION

A woven (greige) fabric of staple polyester fibers, 66 in. wide, weight 6.3 oz./sq.yd. in a 2×1 left handed twill construction having a nominal yarn count of 64×44, and with warp yarns of 12/1 and fill yarns of 15/1 having a warp breaking tensile of 206 lb./in. (ASTM Strip B) with an elongation at breaking tensile of 63.7% and a fill tensile strength of 105 lbs./in. with an elongation at breaking tensile of 51.9% is heat stretched in a manner such as disclosed in U.S. Pat. No. 4,035,961. Such heat stretched fabrics are commercially available.

In a two roll padder which is positioned immediately in front of the heatstretching machine, the fabric is prefinished with a composition comprising 11 parts resorcinol, 16.2 parts formalin solution (37% formaldehyde), 0.3 parts sodium hydroxide and 238.4 parts water. The fabric is not scoured or boiled off prior to the prefinishing and heat stretching operations.

The width of the fabric after heatstretching is 53.5 in. The yarn count of the heatstretched fabric is 75×37 and the warp yarn are noticeably smaller in diameter in the heatstretched fabric than they are in the original greige fabric. The fill yarns appear to be somewhat heavier in the heatstretched than in the greige fabric. The fabric weight is approximately 5.9 oz./sq.yd. The web thickness after heatstretching is 17.1 mils.

The elongation profile of the heatstretched fabric is determined according to the usual techniques on an Instron Tensile Tester. A one inch strip of heatstretched and prefinished polyester fabric is used, gage length 3 inch, chart speed 12 inch/min. and jaw speed of 12 in./min.

The tensile strength of the heatstretched fabric is 279 lbs./in. width with an elongation of 16.9%, the fill tensile strength is 86 lbs./in. width with an elongation of 53%. The elongation profile of the warp is 3.2% at 100 lbs., 8.8% at 200 lbs. and 16.9% at breaking tensile.

The fabric is then subjected to a high temperature high pressure calender to smooth and densify the fabric while maintaining dimensionally stability of the calendered fabric.

The calender employed is a three roll (roll length, 62 inches) gas fired Schreiner calender stack. The top and bottom rolls are mirror finished stainless steel, the center roll is a corn husk roll made of 100% cotton fabric having a hardness of 82 durometer. The top steel roll is heated by gas. The bottom steel roll is heated with steam, the center husk roll is heated by contact transfer from the top and bottom rolls.

The prefinished and dimensionally stabilized polyester fabric is calendered at 230° F., 40 tons pressure (1290 pounds/lineal inch of roll) and at a speed of 30 ft./min. The warp tensile strength of the prefinished, heatstretched and calendered fabric is 276 lbs./in. with an elongation at breaking tensile of 19.4%. The elongation profile of the warp is 4.8% at 100 lbs., 10.4% at 200 lbs. and 19.4% at breaking tensile. The thickness of the calendered fabric is 11.9 mils. The surface roughness of the heatstretched fabric is about 4000 microinches and after calendering it is reduced to about 1500 microinches in terms of the absolute average difference between the peaks and valleys.

The elongation profile and the reduction in surface roughness of the heatstretched fabric is very important where the fabric is to be used on a backing member for the fine grits of coated abrasive material. If the surface roughness of the original heatstretched fabric is not reduced significantly, it will be imparted to the coated abrasive surface which will result in an undesirable scratch pattern on the workpiece being ground.

The dimensionally stabilized and calendered fabric is next coated in its back side (twill) with a composition as follows:

| Component | Parts by Weight |
|---|---|
| A | 1 |
| B | 1 |
| $CaCO_3$ | 2 parts per each part solids A and B. |

Component A is an aqueous resinous composition (72% solids concentration) comprising bisphenol A and formaldehyde (alkaline catalyzed) having a formaldehyde to phenol (F/P) ratio of 3.8 to 1. Component B is a copolymer dispersion, Dur-O-Cryl, obtainable from the C. S. Tanner Co., having a composition in terms of the monomer constituents as follows:

| Component | % by Weight |
|---|---|
| acrylonitrile | 13 |
| methyl methacrylate | 13 |
| butyl acetate | 17 |
| acrylamide | 1 |
| monionic surfactant | 3 |
| water | 53 |

Sufficient composition is applied to result in after drying 5.2 lb./sand paper maker's ream. Drying is accomplished by heating for 0.33 min. at 200° F., 0.33 min. at 225° F. and 0.33 min. at 200° F.

A front size is then applied to the fabric front surface of the following composition:

| Component | Parts by Weight |
|---|---|
| (1) a phenol-formaldehyde resin, F/P 0.94, NaOH catalyzed until ph = 8.1 78% solids in $H_2O$ 78% solids in $H_2O$ | 1 |
| (2) bisphenol A resin (component A above) | 9 |
| (3) $CaCO_3$ particulate filler | equal to solids in (1) and (2) |

Drying is accomplished by heating for 0.33 min. at 225° F., 0.33 min. at 275° F.; and 0.33 min. at 250° F. Sufficient front size composition is applied to result in a dry weight of 4.8 lbs./SPMR.

A maker adhesive having the following composition is then applied to the frontsized backing member in accordance with the usual techniques:

| Component | Parts by Weight |
|---|---|
| (1) Phenol-formaldehyde alkaline catalyzed resol resin F/P factor 2.08, ph 8.7 solids 78% in water. | 7 |
| (2) Phenol-formaldehyde alkaline catalyzed resol resin F/P 0.94, ph 8.1, solids in $H_2O$ 78% | 3 |
| (3) $CaCO_3$ particulate filler | 1.54 × total |

-continued

| Component | Parts by Weight |
|---|---|
| | solids (1) + (2) |

The maker is applied in an amount equal to 2 lbs./SPMR.

To the adhesively coated fabric is then applied by conventional elastostatic means 8.3 lbs./SPMR grit 320 high purity aluminum oxide abrasive grain. The abrasive-adhesive coated backing member is then heated for 25 mins. at 170° F., 25 min. at 190° F., and 47 min. at 225° F. to provide a dry adhesive layer (1.8 lbs./SPMR) to anchor the abrasive grains to the desired orientation.

Afterwards a size coat (3.3 lbs./SPMR, dry) of the same composition as the maker coat, except for a lower viscosity, is then applied according to the usual techniques. The wet adhesive layer is then dried—25 mins. at 125° F., 25 min. at 135° F., 18 min. at 180° F., 25 mins. at 190° F., and 15 minutes at 225° F. after which a final cure at 230° F. for 8 hours is given. The coated abrasive material is then ready to be manufactured according to the usual techniques, into belts, discs and other desired abrasive products.

In a grit 150, the same backing was used as described above except the prefinish was not applied to the fabric. The maker weight for grit 150 $Al_2O_3$, is 4.2 lbs./SPMR with a grain deposition of 10.6 lbs./SPMR. The size adhesive of lower viscosity than the maker is applied 3.3 lbs./SPMR dry.

What is claimed is:

1. A fine grit flexible coated abrasive sheet having a heat calendered cloth backing woven of polyester yarn, said backing, exclusive of coatings, having a weight of 3.5–9.5 oz./sq.yd. a stretch profile in the warp direction of $\leqq 6\%$ at 50 lbs. $\leqq 9\%$ at 100 lbs. and $<15\%$ at 200 lbs. tensile strength and having on the side to which the maker coat is applied, a fabric surface which is defined by a surface roughness reduction from uncalendered heatstretched cloth of from 55 to 85%, a thickness reduction of 20 to 35%, and a peel strength adhesion reduction of $\leqq 40\%$.

2. A fine grit coat abrasive product according to claim 1, where the surface roughness of the calendered is preferably reduced from 65–75%, the thickness reduced 25–30%, the peel adhesion strength reduced $\leqq 20\%$.

* * * * *